US008285187B2

(12) United States Patent
Kimura et al.

(10) Patent No.: US 8,285,187 B2
(45) Date of Patent: Oct. 9, 2012

(54) IMAGE GLOSS CONTROL APPARATUS, IMAGE FORMING APPARATUS, IMAGE FORMING SYSTEM, AND STORAGE MEDIUM STORING PROGRAM

(75) Inventors: Hideki Kimura, Ebina (JP); Masahiko Kubo, Ebina (JP); Tomoshi Hara, Ebina (JP); Shinsuke Sugi, Ebina (JP); Toshihiro Matsumoto, Ebina (JP); Kenji Mori, Ebina (JP); Nobukazu Takahashi, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 283 days.

(21) Appl. No.: 12/711,926

(22) Filed: Feb. 24, 2010

(65) Prior Publication Data

US 2011/0064436 A1 Mar. 17, 2011

(30) Foreign Application Priority Data

Sep. 17, 2009 (JP) ..... 2009-215670

(51) Int. Cl.
*G03G 15/20* (2006.01)

(52) U.S. Cl. ..... 399/341

(58) Field of Classification Search ..... 399/67, 399/68, 69, 341
See application file for complete search history.

(56) References Cited

U.S. PATENT DOCUMENTS

| | | | | |
|---|---|---|---|---|
| 5,260,753 | A | 11/1993 | Haneda et al. | |
| 6,535,712 | B2 * | 3/2003 | Richards | 399/341 |
| 7,412,198 | B2 * | 8/2008 | Isemura et al. | 399/341 |
| 7,912,415 | B2 * | 3/2011 | Shiozawa | 399/341 |
| 2006/0133870 | A1 * | 6/2006 | Ng et al. | 399/341 |
| 2006/0210295 | A1 | 9/2006 | Nakaya et al. | |
| 2007/0268511 | A1 | 11/2007 | Crichton et al. | |

FOREIGN PATENT DOCUMENTS

| | | | |
|---|---|---|---|
| EP | 1503255 | A1 | 2/2005 |
| JP | 04-338984 | A | 11/1992 |

OTHER PUBLICATIONS

European Search Report dated Apr. 20, 2010 for European Application No. 10154446.8-1240.

* cited by examiner

*Primary Examiner* — Sandra Brase
(74) *Attorney, Agent, or Firm* — Sughrue Mion, PLLC

(57) ABSTRACT

An image gloss control apparatus that includes a first control component and a second control component is provided. The first control component controls an image forming/fixing component, which forms an image on a recording medium using a colored image formation material and fixes the image, so that a first image is formed in a high gloss area having a high gloss level on the recording medium or an area including the high gloss area on the recording medium and is fixed. The second control component that controls the image forming/fixing component, so that a second image having a density lower than a density of the first image is formed in a low gloss area having a gloss level lower than the gloss level of the high gloss area on the recording medium where the first image is formed or the low gloss area on the first image and is fixed.

21 Claims, 14 Drawing Sheets

FIXING CONDITION OF FIRST PASS

| PATTERN | FIXING TEMPERATURE | FIXING SPEED | CONTACT WIDTH |
|---|---|---|---|
| 1 | HIGH | LOW | WIDE |
| 2 | COMMON | LOW | WIDE |
| 3 | HIGH | COMMON | WIDE |
| 4 | HIGH | LOW | COMMON |
| 5 | HIGH | COMMON | COMMON |
| 6 | COMMON | LOW | COMMON |
| 7 | COMMON | COMMON | WIDE |
| 8 | COMMON | COMMON | COMMON |

IMAGE GLOSS CONTROL APPARATUS, IMAGE FORMING APPARATUS, IMAGE FORMING SYSTEM, AND STORAGE MEDIUM STORING PROGRAM

CROSS-REFERENCE TO RELATED APPLICATIONS

This application is based on and claims priority under 35 USC 119 from Japanese Patent Application No. 2009-215670 filed Sep. 17, 2009.

BACKGROUND

1. Technical Field

The invention relates to an image gloss control apparatus, an image forming apparatus, an image forming system, and a storage medium storing a program.

2. Related Art

An image forming apparatus that selectively forms a transparent toner layer on a portion needed to increase a gloss level of an image has been known.

SUMMARY

According to an aspect of the invention, there is provided an image gloss control apparatus that comprises: a first control component that controls an image forming/fixing component, which forms an image on a recording medium using a colored image formation material and fixes the image, so that a first image is formed in a high gloss area having a high gloss level on the recording medium or an area including the high gloss area on the recording medium and is fixed; and a second control component that controls the image forming/fixing component, so that a second image having a density lower than a density of the first image is formed in a low gloss area having a gloss level lower than the gloss level of the high gloss area on the recording medium where the first image is formed or the low gloss area on the first image and is fixed.

BRIEF DESCRIPTION OF THE DRAWINGS

Exemplary embodiments of the present invention will be described in detail based on the following figures, wherein.

DETAILED DESCRIPTION

Hereinafter, exemplary embodiments will be described in detail with reference to the accompanying drawings.

First Exemplary Embodiment

Figure 1:
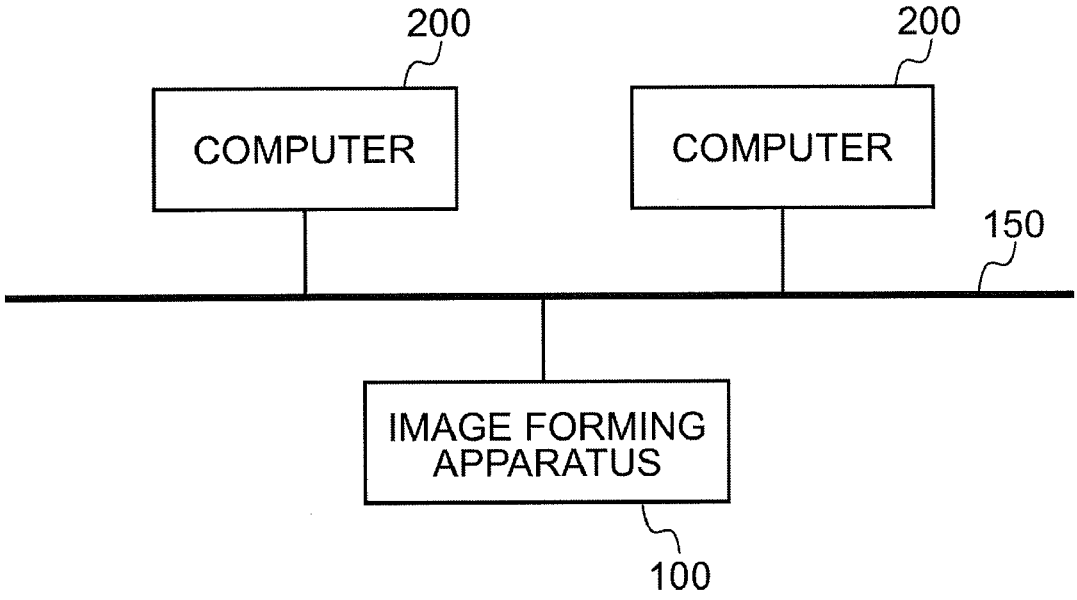
FIG. 1 is a diagram illustrating a state where an image forming apparatus according to exemplary embodiments and computers are connected through a communication component.

In the first exemplary embodiment, an image forming apparatus 100 and computers 200 are connected through a communication component 150, as illustrated in FIG. 1. The communication component 150 may be a public circuit or a network, such as the Internet, a local area network (LAN), and a wide area network (WAN). Although not illustrated in the drawings, when the image forming apparatus 100 and the computer 200 are provided in a one-to-one relation, the communication component 150 may be a cable that connects the image forming apparatus 100 and the computer 200 in peer-to-peer fashion. The communication component 150 may be a wireless communication component or a wired communication component.

Figure 2:
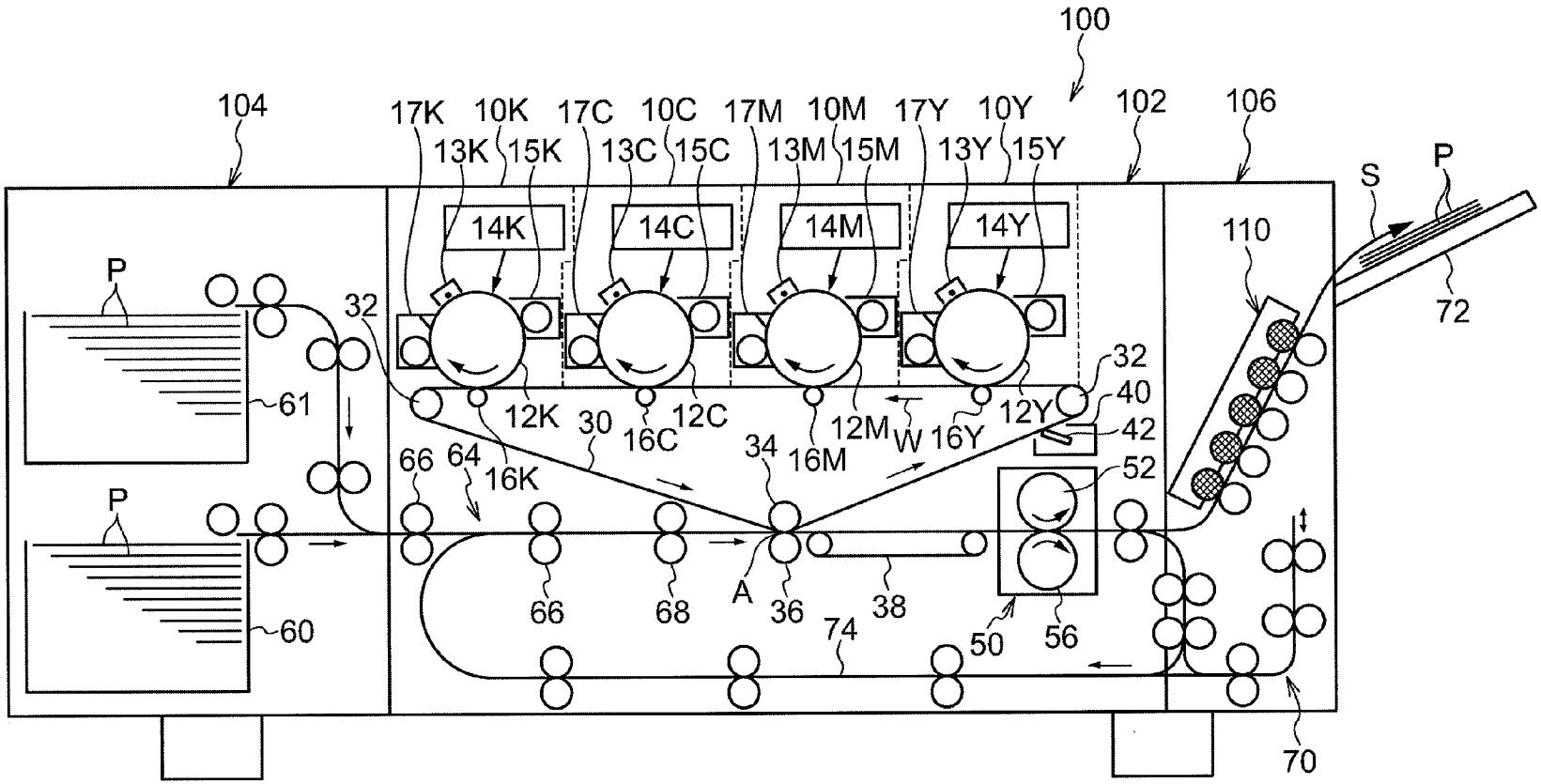
FIG. 2 is a diagram illustrating the schematic configuration of the image forming apparatus according to the exemplary embodiments.

The image forming apparatus 100 generates image data for individual colors of yellow (Y), magenta (M), cyan (C), and black (K), and forms an image on a recording medium (recording paper P in the first exemplary embodiment), on the basis of each image data. In the description below, image forming that is performed by the image forming apparatus 100 may be called print. FIG. 2 illustrates the schematic configuration of the image forming apparatus 100.

The image forming apparatus 100 includes an image forming/fixing portion 102, a feed portion 104, and a discharge portion 106.

The image forming/fixing portion 102 includes image forming units 10Y, 10M, 10C, and 10K that form toner images of the individual colors of Y, M, C, and K.

The image forming units 10Y, 10M, 10C, and 10K are linearly arranged in a movement direction W of an endless intermediate transfer belt 30 that are supported by a backup roll 34 and plural rolls 32. The intermediate transfer belt 30 is inserted between photoreceptors 12Y, 12M, 12C, and 12K of the image forming units 10Y, 10M, 10C, and 10K and primary transfer rolls 16Y, 16M, 16C, and 16K that are disposed to face the individual photoreceptors 12.

Hereinafter, when Y, M, C, and K need to discriminate from each other, any one of Y, M, C, and K is added to each reference numeral, and when Y, M, C, and K do not need to discriminate from each other, Y, M, C, and K are not added to the reference numerals.

Each image forming unit 10 includes a photoreceptor 12, a charger 13, an exposing device 14, a developing device 15, a primary transfer roll 16, and a cleaning device 17.

A surface of the photoreceptor 12 is charged by the charger 13. The exposing device 14 exposures the charged photoreceptor 12 on the basis of image data of each color, and forms an electrostatic latent image on the surface of the photoreceptor 12.

The electrostatic latent image that is formed on the photoreceptor 12 is developed by the developing device 15 using a colored image formation material (toner in this case), and becomes a toner image of any one of Y, M, C, and K. The primary transfer roll 16 is conveyed with the intermediate transfer belt 30 between the photoreceptor 12 and the primary transfer roll 16, generates an electrostatic absorbing force by an applied transfer bias, and primarily transfers a toner image, which is formed on the photoreceptor 12, to the intermediate transfer belt 30. After the primary transfer, a remaining non-transferred toner that remains on the photoreceptor 12 is removed by the cleaning device 17. After the surface of the photoreceptor 12 is discharged by a discharger (not illustrated), the surface of the photoreceptor 12 is charged by the charger 13 for a next image formation cycle.

In the image forming apparatus 100, the image forming process is executed for each of the image forming units 10Y, 10M, 10C, and 10K at timing that considers a relative positional difference of the individual image forming units 10Y, 10M, 10C, and 10K, the toner images of the individual colors of Y, M, C, and K are sequentially overlapped on the intermediate transfer belt 30, and a toner image of a full color is formed. When a monochrome image is formed, a monochrome toner image of the color of K is transferred to the intermediate transfer belt 30.

The toner image that is formed on the intermediate transfer belt 30 is secondarily transferred to the recording paper P by the secondary transfer roll 36. The secondary transfer roll 36 nips the recording paper P conveyed to a secondary transfer position A with the intermediate transfer belt 30 supported to the backup roll 34, generates the electrostatic absorbing force by the applied transfer bias, and secondarily transfers the toner image on the intermediate transfer belt 30 to the recording paper P.

The recording paper P is accommodated in feed cassettes 60 and 61 of the feed portion 104 that is disposed at a front stage of the image forming/fixing portion 102. The recording paper P is fed from any one of the feed cassettes 60 and 61 to the image forming/fixing portion 102. The fed recording paper P is fed to a secondary transfer position A by conveyance rolls 66 and resist rolls 68 of a conveyance mechanism 64. As described above, the toner images are collectively transferred from the intermediate transfer belt 30 to the recording paper P by the backup roll 34 and the secondary transfer roll 36.

The non-transferred toner remaining on the intermediate transfer belt 30 that is not transferred to the recording paper P at the time of the secondary transfer is extracted and removed by a cleaning blade 42 of the cleaning device 40.

The recording paper P where the toner image is transferred from the intermediate transfer belt 30 is separated from the intermediate transfer belt 30. Then, the recording paper P is conveyed to a fixing device 50 by a conveyance belt 38 that is disposed on the downstream side of the secondary transfer position A.

The fixing device 50 includes a heating/fixing roll 52 that has a heating element, such as a halogen lamp, in a metallic core having high thermal conductivity. The fixing device 50 further includes a pressurization roll 56 that forms a pair together with the heating/fixing roll 52 and pressurizes the conveyed recording paper P.

The surface of the recording paper P where the non-fixed toner image is transferred becomes the side of the heating/fixing roll 52, and the recording paper P is nipped and conveyed by the heating/fixing roll 52 and the pressurization roll 56. At this time, the toner image is fixed on the recording paper P by the heat and the pressure.

The recording paper P where the toner image is fixed by the fixing device 50 is fed to the discharge portion 106. The recording paper P is discharged to a discharge board 72 by a discharge mechanism 110 of the discharge portion 106.

The image forming apparatus 100 includes a mechanism that inverses the surface and the back surface of the recording paper P where the toner image is fixed on one surface, conveys the recording paper P to the secondary transfer position A again, transfers a new toner image to the other surface from the intermediate transfer belt 30, and prints image data on both surfaces of the recording paper P.

Specifically, after the recording paper P is inverted by an inversion conveyance mechanism 70 of the discharge portion 106, the recording paper P is conveyed to the conveyance mechanism 64 along a conveyance path 74, the other surface of the recording paper P becomes the side of the intermediate transfer belt 30 by the conveyance mechanism 64, and the recording paper P is fed to the secondary transfer position A.

After the toner image is transferred to the other surface of the recording paper P, the toner image is fixed to the other surface by the fixing device 50, and the recording paper P is discharged to the discharge board 72 by the discharge mechanism 110 of the discharge portion 106.

The above-described image forming/fixing processes are processes that are executed in a common mode. The image forming apparatus 100 according to the first exemplary embodiment has a mode (partial gloss mode) where an image (hereinafter, referred to as partial gloss image), which has an area having a relatively high gloss level and an area having a relatively low gloss level, is formed on the recording paper P, in addition to the common mode. In the partial gloss mode, the recording paper P where the image is printed on one surface is conveyed again to the secondary transfer position A without using the inversion conveyance mechanism 70 (without inverting the surface and the back surface), and an image is printed on one surface again. That is, in the partial gloss mode, print is performed twice with respect to one surface of the recording paper P. Hereinafter, the print that is performed twice in the partial gloss mode is discriminately called first pass print (or first pass) and second pass print (or second pass). An image that is formed in the first pass is called a first image and an image that is formed in the second pass is called a second image. The detailed configuration of the partial gloss mode will be described below.

Figure 3:
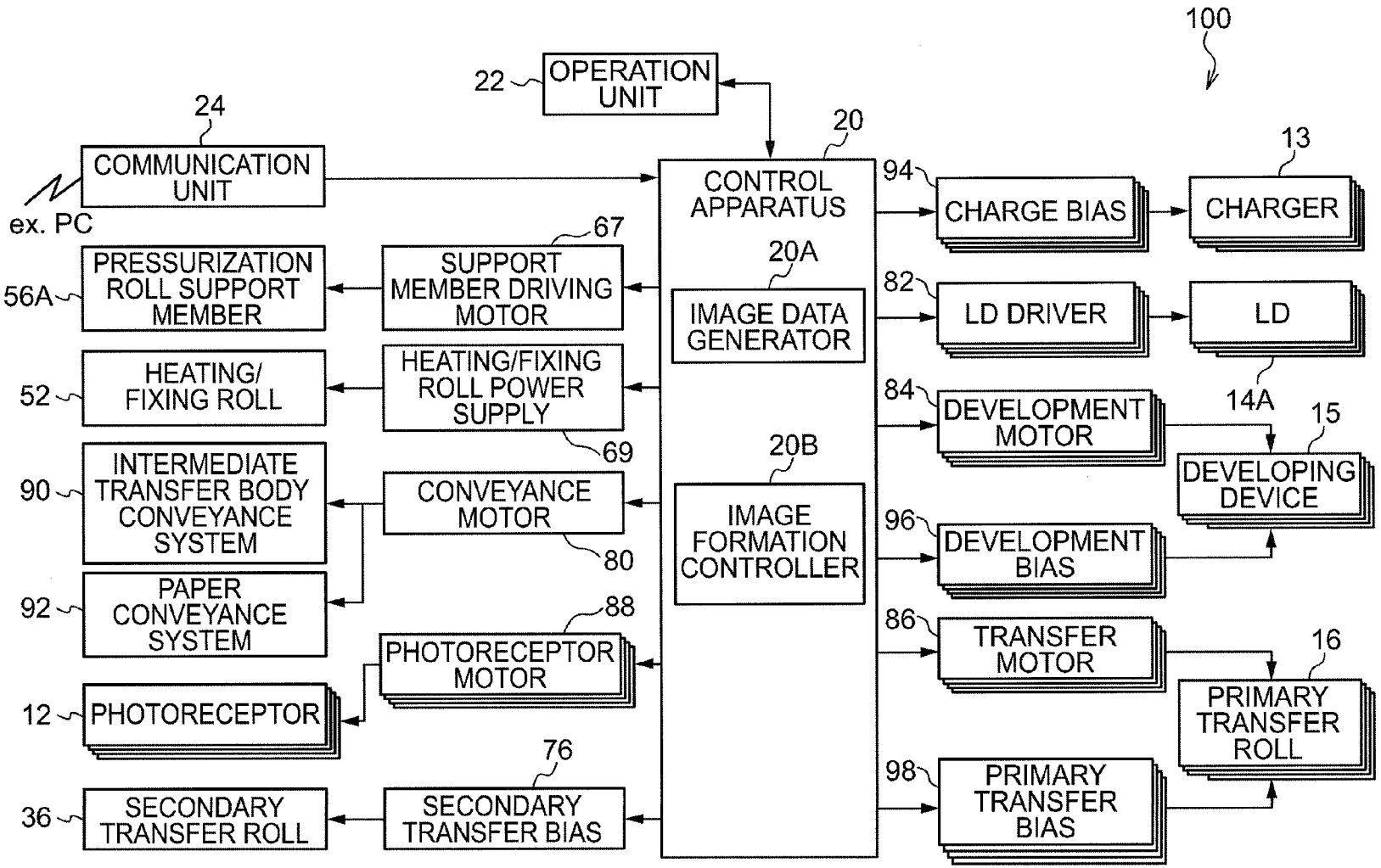
FIG. 3 is a block diagram illustrating the configuration of a control system of the image forming apparatus according to the exemplary embodiments.

FIG. 3 is a block diagram illustrating the configuration of a control system of the image forming apparatus 100. As illustrated in FIG. 3, in the image forming apparatus 100, an operation unit 22 and a communication unit 24 are connected to a control apparatus 20.

The operation unit 22 is composed of a touch panel display, and displays a variety of information or receives a print instruction or an instruction of a variety of setting information that a user contacts the operation unit 22 and inputs. The operation unit 22 is not limited to the touch panel display. For example, the operation unit 22 may include plural buttons and a display device may be separately provided.

When the control apparatus 20 receives the print instruction from the operation unit 22 and when the control apparatus 20 receives the print instruction transmitted from the computer 200 through the communication unit 24, the control apparatus 20 controls various components of the image forming apparatus 100 to form an image using print information received together with the print instruction.

The print information includes information to specify a printed image. The information may be image data. The print information includes information indicating a print condition, such as an original size, a print color (color/monochrome), a designation of a partial gloss mode, gloss area specifying information (which will be described in detail below), a designation of one-sided/both-sided print, an imposition designation, enlargement/reduction setting, a print paper size, and the number of printed copies. The print information may be described using a page description language.

In this case, when the print is instruction through the operation unit 22, the operator operates the operation unit 22 and designates print information. When the print is instructed from the computer 200, the user designates print information using a function that is provided by a program (for example, printer driver) operated on the computer 200. The print information that is designated by the operation unit 22 or the print information that is received from the computer 200 is stored in an HDD 173 of the control apparatus 20 to be described in detail below.

In FIG. 3, the electrical configuration of the image forming apparatus 100 is also illustrated. As illustrated in FIG. 3, the image forming apparatus 100 includes a conveyance motor 80, an a laser diode (LD) driver 82 that lights an LD of the exposing device 14A, a motor (hereinafter, referred to as "development motor") 84 that drives the developing device 15, a motor (hereinafter, referred to as "transfer motor") 86 that moves the primary transfer roll 16, and a motor (hereinafter, referred to as "photoreceptor motor") 88 that rotates the photoreceptor 12. The conveyance motor 80, the LD driver 82, the development motor 84, the transfer motor 86, and the photoreceptor motor 88 are connected to the control apparatus 20.

The conveyance motor 80 is connected to an intermediate transfer body driving system 90 that rotates the intermediate transfer belt 30, including the backup roll 34, and a paper conveyance system 92 that conveys the recording paper P. The paper conveyance system 92 includes rolls that are rotatably provided in the conveyance belt 38, the inversion conveyance mechanism 70, the conveyance path 74, and the discharge mechanism 110, in addition to the conveyance roll 66, the resist roll 68, and the pressurization roll 56 illustrated in FIG. 2. If the conveyance motor 80 is driven, the rotation force thereof is transmitted to the intermediate transfer body driving system 90 and the paper conveyance system 92. As a result, the intermediate transfer belt 30 rotates in a direction of an arrow W illustrated in FIG. 2, and a series of conveyance of the recording paper P along the conveyance path is performed.

The photoreceptor motor 88 is provided for each image forming unit 10 and is connected to the photoreceptor 12 in the corresponding image forming unit 10. When the photoreceptor motor 88 is driven, the rotation force thereof is transmitted to the photoreceptor 12, and the photoreceptor 12 rotates in a direction of the arrow illustrated in FIG. 2.

The LD driver 82 is provided for each image forming unit 10 and is connected to an LD that is a light source of the exposing device 14A in the corresponding image forming unit 10. The LD driver 82 receives a lightening signal according to the image data from the control apparatus 20, and turns on/off the LD on the basis of the received lightening signal.

The development motor 84 is provided for each image forming unit 10. In the image forming apparatus 100, if the development motor 84 rotates, the rotation force thereof is transmitted to the developing device 15 in the corresponding image forming unit 10, and the developing device 15 is driven.

The transfer motor 86 is provided for each image forming unit 10. During the print, if the transfer motor 86 rotates, the primary transfer roll 16 in the corresponding image forming unit 10 is pushed to and contacts a circumferential surface of the photoreceptor 12.

The charger 13, the primary transfer roll 16, the developing device 15, and the secondary transfer roll 36 need a high voltage source. In order to supply the high voltage to the above components, the image forming apparatus 100 includes a bias power supply unit (hereinafter, referred to as charge bias power supply) 94 for the charger 13, a bias power supply unit (hereinafter, referred to as development bias power supply) 96 for the developing device 15, a bias power supply unit (hereinafter, referred to as primary transfer bias power supply) 98 for the primary transfer roll 16, and a bias power supply unit (hereinafter, referred to as secondary transfer bias power supply) 76 for the secondary transfer roll 36, which are connected to the control apparatus 20.

The charge bias power supply 94 is provided for each image forming unit 10 and is connected to the charger 13 in the corresponding image forming unit 10, such that the high voltage may be applied. In the image forming apparatus 100, if the high voltage is applied from the charge bias power supply 94 to the charger 13, the charger 13 is charged and the photoreceptor 12 is charged by the charged charger 13.

The development bias power supply 96 is provided for each image forming unit 10 and is connected to the developing device 15 in the corresponding image forming unit 10, such that the high voltage may be applied. In the image forming apparatus 100, if the high voltage is applied from the development bias power supply 96 to the development device 15, the toner in the developing device 15 is charged and electrostatically adhered to a latent image portion of the photoreceptor 12 to develop the image.

The primary transfer bias power supply 98 is provided for each image forming unit 10 and is connected to the primary transfer roll 16 in the corresponding image forming unit 10, such that the high voltage may be applied. In the image forming apparatus 100, if the high voltage is applied from the primary transfer bias power supply 98 to the primary transfer roll 16, the primary transfer roll 16 is charged, and the tone image on the photoreceptor 12 is electrostatically transferred to the intermediate transfer belt 30.

The secondary transfer bias power supply 76 is connected to the secondary transfer roll 36 such that the high voltage may be applied. In the image forming apparatus 100, if the high voltage is applied from the secondary transfer bias power supply 76 to the secondary transfer roll 36, the secondary transfer roll 36 is charged, and the tone image on the intermediate transfer belt 30 is electrostatically transferred to the recording paper P.

The control apparatus 20 is connected to a heating/fixing roll power supply 69. The heating/fixing roll power supply 69 supplies power to heat the heating/fixing roll 52 to a heating element provided in the heating/fixing roll 52.

The control apparatus 20 is connected to a support member driving motor 67. The support member driving motor 67 is a motor that vertically moves with respect to a pressurization roll support member 56A (not illustrated in FIG. 2) supporting a roll shaft of the pressurization roll 56. If the pressurization roll support member 56A vertically moves, the pressurization roll 56 vertically moves. Thereby, a contact width (also called a nip width) with the heating/fixing roll 52 changes. In the first exemplary embodiment, the pressurization roll support member 56A is configured to move in two steps in a vertical direction.

The control apparatus 20 includes functions of an image data generator 20A that generates image data (hereinafter, referred to as output image data) for each color of Y, M, C, and K used in the exposing device 15 when the image is formed by the image forming/fixing portion 102, on the basis of the print information, and an image formation controller 20B that controls an image forming operation (including a fixing operation in this case).

The image data generator 20A analyzes the print information and generates output image data.

The image formation controller 20B controls driving of the conveyance motor 80, the LD driver 82, the development motor 84, the transfer motor 86, the photoreceptor motor 88, and the support member driving motor 67, or ON/OFF or a level of an applied voltage of the charge bias power supply 94, the development bias power supply 96, the primary transfer bias power supply 98, the secondary transfer bias power supply 76, and the heating/fixing roll power supply 69, and controls the image forming operation of the image forming unit.

Figures 4, 5:
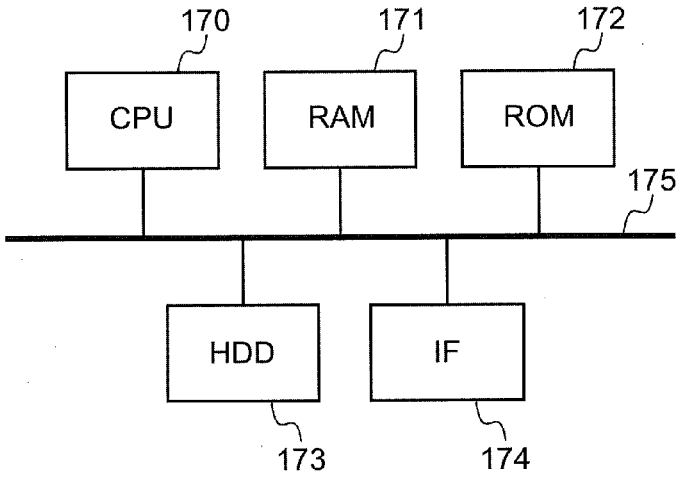
FIG. 4 is a diagram illustrating an example of the hardware configuration of a control apparatus.
FIG. 5 is a diagram illustrating a specific example of a fixing condition of a first pass.

FIG. 4 illustrates an example of the hardware configuration of the control apparatus 20.

The control apparatus 20 according to the first exemplary embodiment is configured such that a central processing unit (CPU) 170, a random access memory (RAM) 171, a read only memory (ROM) 172, a hard disk drive (HDD) 173, and an interface (IF) 174 are connected through a bus 175.

The CPU 170 executes a program (including a program of a process routine to be described in detail below) that is stored in the ROM 172 or the HDD 173, and controls the whole operation of the image forming apparatus 100. The ROM 172 stores a program that is executed by the CPU 170 or data that is needed for a process of the CPU 170. The RAM 171 is used as a work memory. The functions of the image data generator 20A and the image formation controller 20B are realized by executing the program by the CPU 170.

A storage medium that stores the program executed by the CPU 170 is not limited to the HDD 173 or the ROM 172. For example, the storage medium may be a flexible disk, a DVD disk, a magneto-optical disk, or a USB memory (not illustrated), and may be a storage medium of another apparatus that is connected to the communication component 150.

The HDD 173 stores the program executed by the CPU 170 or a variety of data. The HDD 173 also stores information of a dither matrix that is used when the output image data is generated. Also, the HDD 173 previously stores a variety of setting information that is used in a partial gloss mode. In the first exemplary embodiment, it is assumed that information indicating a look-up table (LUT) used during image processing executed when the output image data is generated and information indicating the fixing condition of the first pass are stored as the setting information.

The LUT that corresponds to a table indicating a conversion rule used to convert a gradation value (density) of multi-valued image data illustrates a conversion rule to convert a density before the conversion into a density lower than the density before the conversion. As the LUT, one kind of LUT may be stored or plural kinds of LUTs having different conversion characteristics may be stored. When the plural kinds of LUTs are stored, setting information indicating which LUT is used is previously stored in the HDD 173 (or the user may designate the used LUT through the operation unit 22). In the first exemplary embodiment, the LUT is used as the conversion rule, but a function may be used as the conversion rule.

The fixing condition includes at least one of the fixing temperature of the fixing device 50 of the first pass (temperature of the heating/fixing roll 52 or the heating element of the heating/fixing roll 52), the fixing speed (speed at which the recording paper P pass through the fixing device 50), and the width (contact width) of the contact portion in the rotation direction of the heating/fixing roll 52 and the pressurization roll 56.

FIG. 5 illustrates a specific example of the fixing condition of the first pass. In the fixing temperature, the "common temperature" indicates the predetermined fixing temperature at the time of fixing in a common mode. Meanwhile, the "high temperature" indicates the predetermined fixing temperature that is higher than the common temperature. In the fixing speed, the "common speed" indicates the predetermined fixing speed at the time of fixing in the common mode. Meanwhile, the "low speed" indicates the predetermined fixing speed that is slower than the common speed. In the contact width, the "common width" indicates the predetermined contact width at the time of fixing in the common mode. Meanwhile, the "wide" indicates the predetermined contact width that is wider than the common width.

When the fixing temperature at the time of fixing increases, the amount of heat per unit area with respect to the toner image transferred to the recording paper P increases. As a result, a resin that is contained in the toner may be easily melted and the surface of the toner image is smoothened. When the fixing speed becomes slow, the fixing time increases, and the amount of heat per unit area with respect to the toner image transferred to the recording paper P increases. As a result, the surface of the toner image is smoothened. When the contact width increases, the fixing time increases, and the amount of heat per unit area with respect to the toner image transferred to the recording paper P increases. As a result, the surface of the toner image is smoothened.

The setting information may be previously set by the user through the operation unit 22 and stored, or an initial value may be previously stored in a manufacturing step of the image forming apparatus 100. In the first exemplary embodiment, the fixing condition of a pattern 1 is previously set. However, the user may change the setting.

In the first exemplary embodiment, in the second pass, the toner image is fixed under the fixing condition in the common mode.

The I/F 174 is an interface that is used to connect the operation unit 22, the communication unit 24, the conveyance motor 80, the LD driver 82, the development motor 84, the transfer motor 86, the photoreceptor motor 88, the support member driving motor 67, the charge bias power supply 94, the development bias power supply 96, the primary transfer bias power supply 98, the secondary transfer bias power supply 76, and the heating/fixing roll power supply 69.

Figure 6:
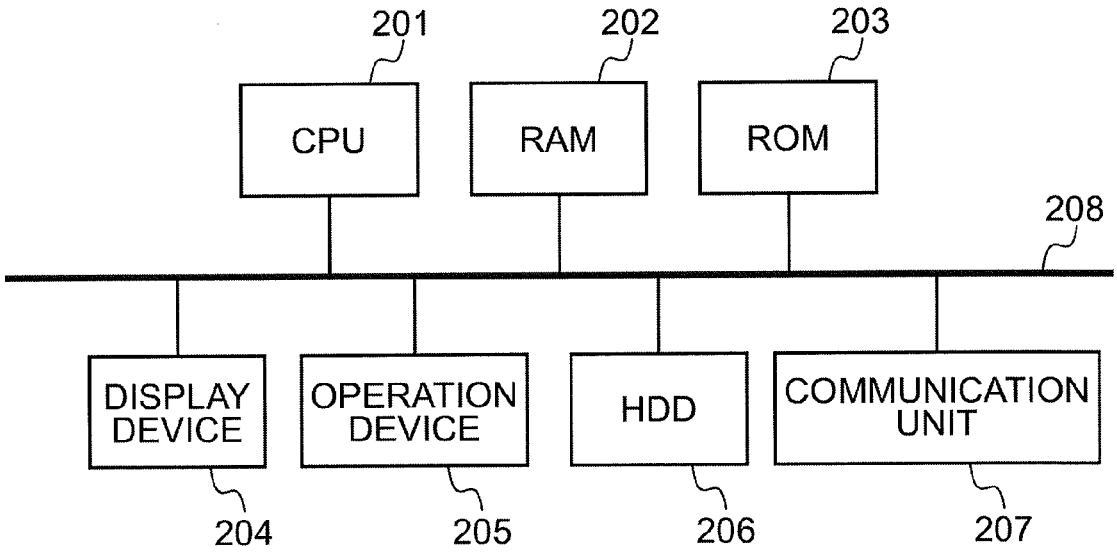
FIG. 6 is a diagram illustrating an example of the hardware configuration of the computer.

FIG. 6 illustrates an example of the hardware configuration of the computer 200.

The computer 200 according to the first exemplary embodiment is configured such that a central processing unit (CPU) 201, a random access memory (RAM) 202, a read only memory (ROM) 203, a display device 204, an operation device 205, a hard disk drive (HDD) 206, and a communication unit 207 are connected through a bus 208.

The CPU 201 executes a program that is stored in the ROM 203 or the HDD 206 and controls the whole operation of the computer 200. The ROM 203 stores a program (for example, program that is used to generate print information needed to print image data generated by application software and transmit the print information to the image forming apparatus 100) that is executed by the CPU 201 or data that is needed for a process of the CPU 201. The RAM 202 is used as a work memory.

A storage medium that stores the program executed by the CPU 201 is not limited to the HDD 206 or the ROM 203. For example, the storage medium may be a flexible disk, a DVD disk, a magneto-optical disk, or a USB memory (not illustrated), and may be a storage medium of another apparatus that is connected to the communication component 150.

The display device 204 is composed of a liquid crystal display, and displays various images or messages under the control of the CPU 201.

The operation device 205 is composed of a keyboard or a mouse, and receives a variety of information that in input when the user operates the operation device 205.

The HDD 206 stores the program executed by the CPU 201 or a variety of data. The communication unit 207 is an interface that is used to exchange data with another apparatus through the communication component 150.

Next, the operation of the image forming apparatus 100 according to the first exemplary embodiment in the partial gloss mode will be described.

Figure 7:
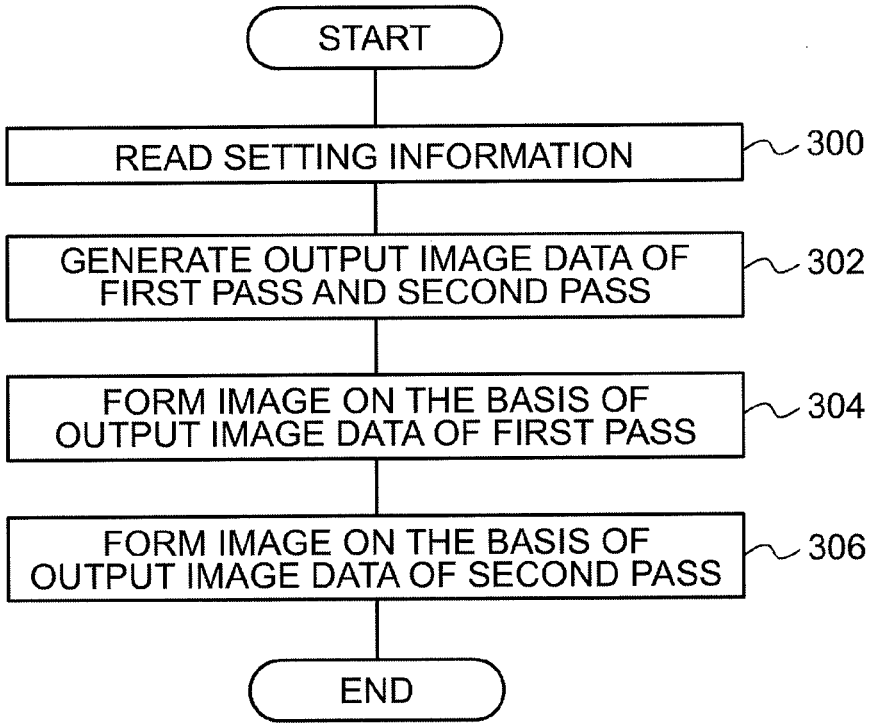
FIG. 7 is a flowchart illustrating a flow of a process routine that is executed by the control apparatus.

FIG. 7 is a flowchart illustrating a flow of a process routine according to the first exemplary embodiment that is executed by the control apparatus 20. The process routine starts when the control apparatus 20 receives a print instruction and the designation of the partial gloss mode included in the print information received together with the print instruction is "YES" (that is, the print information indicates that print is performed in the partial gloss mode).

In step 300, the image data generator 20A reads the setting information used in the partial gloss mode, from the HDD 173.

In step 302, the image data generator 20A generates output image data that is used in image forming of the first pass and output image data that is used in image forming of the second pass. Specifically, the image data generator 20A generates the output image data as follows.

<Generation of Output Image Data of the First Pass>

First, the image data generator 20A calculates a density (gradation value) of each color of Y, M, C, and K that are development colors of the image forming apparatus 100 for individual pixels of an origin image, on the basis of information to specify a printed image (hereinafter, referred to as original image) included in the print information. The density becomes any value of 0 to 255, when the density is represented by data of 8 bits. In this case, a value of 0 is defined as a lowest density (that is, density of 0%) and a value of 255 is defined as a highest density (that is, density of 100%). In contrast, the value of 255 may be defined as the lowest density and the value of 0 may be defined as the highest density.

As such, the image data generator 20A calculates the density for each pixel and generates multi-valued image data for each color indicating the original image. When the information to specify the original image is image data, the image data generator 20A extracts the image data from the print information and acquires the image data (also refers to the original image of FIG. 8).

The image data generator 20A executes known dither processing (or error spread processing) with respect to each of the multi-valued image data of the individual color of Y, M, C, and K indicating the original image, using the dither matrix stored in the HDD 173, digitizes the image data, and generates output image data of the first pass (that is, output image data to form a first image).

<Generation of Output Image Data of the Second Pass>

Next, the image data generator 20A extracts gloss area specifying information from the print information. The gloss area specifying information is information that specifies a high gloss area having a high gloss level and a low gloss area having a low gloss level, in the original image.

Figure 8:
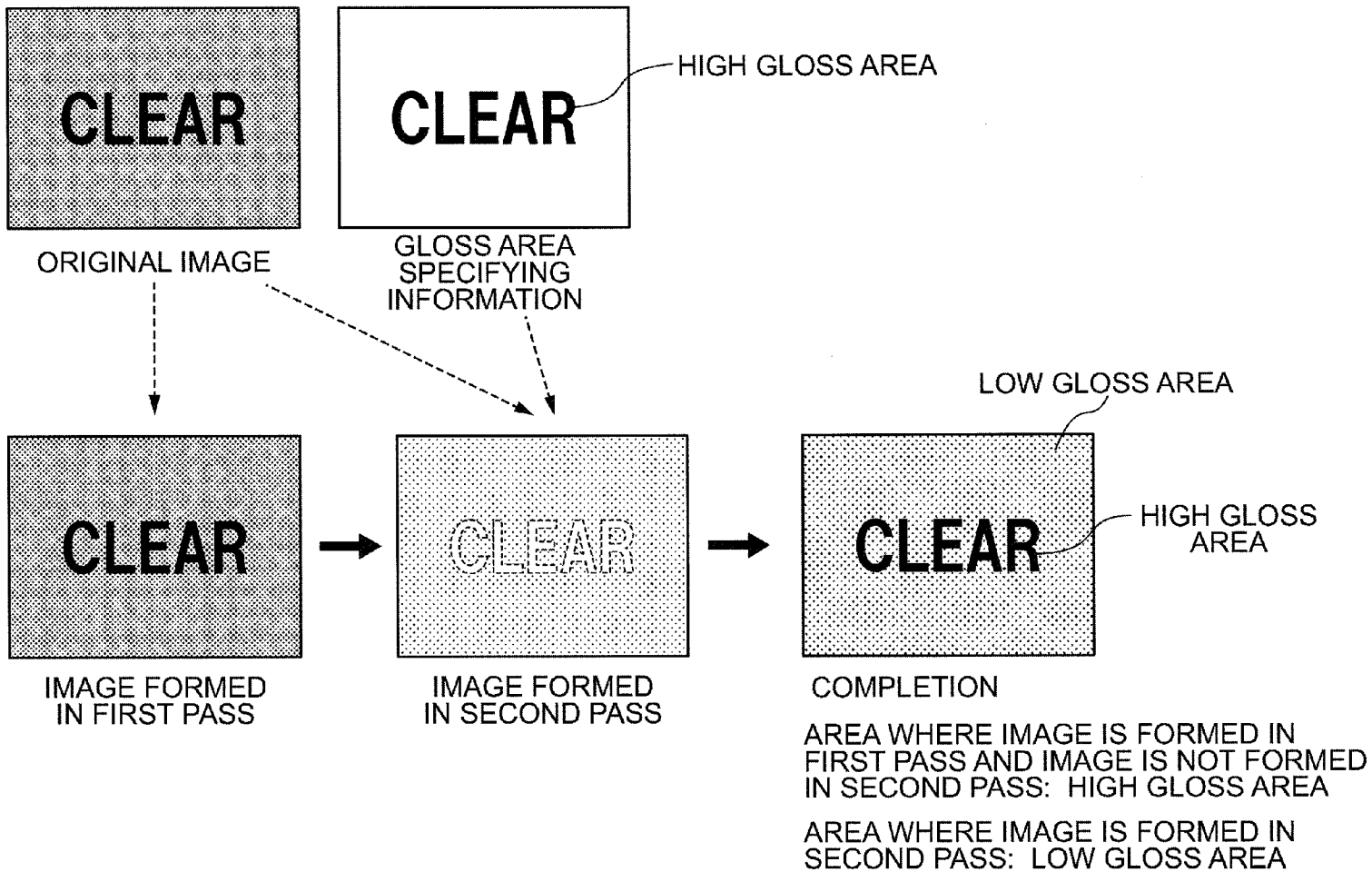
FIG. 8 is a diagram illustrating a forming sequence of a partial gloss image.

The gloss area specifying information may be image data of a bitmap indicating an image where a low gloss area is represented with a low density of 0 or 0 to d1 (predetermined density), and a high gloss area is represented with a high density of 255 or 255 to d2 (predetermined density) (in this case, d1<d2) (also refer to the gloss area specifying information of FIG. 8). The gloss area specifying information may be digitized image data of a bitmap indicating an image where a low gloss area is represented with a density of 0 and a high gloss area is represented with a density of 1. Each position and range of the low gloss area and the high gloss area may be illustrated by a character or a code.

The gloss area specifying information may be information that specifies only the high gloss area. In this case, an area other than the high gloss area may be handled as the low gloss area.

The image data generator 20A generates multi-valued image data where the density of each pixel of the high gloss area is set to 0 (white) and the density of each pixel in the low gloss area of the original image is decreased to the predetermined density or less. In the first exemplary embodiment, the image data generator 20A executes a density decreasing process that decreases the density of each pixel of the low gloss area to the predetermined density or less, using the LUT for decreasing the density stored in the HDD 175. In this case, as the LUT, a common LUT is used in each color of Y, M, C, and K, but different LUTs may be used.

The image data generator 20A may set the gloss area specifying information as image data of the bitmap indicating the image where the low gloss area is represented with the density of 0 and the high gloss area is represented with the density of 1, generate image data of an inversion image where 0 and 1 of the image data are inverted, and execute the density decreasing process using the LUT with respect to image data generated by multiplying the image data of the inversion image and the multi-valued image data of the original image for each pixel.

The image data generator 20A executes the known dither processing with respect to the multi-valued image data after the density decreasing process, using the dither matrix stored in the HDD 173, digitizes the image data, and generates output image data of the second pass (that is, output image data to form a second image).

Next, the above-described density decreasing process will be described in detail.

Figure 9:
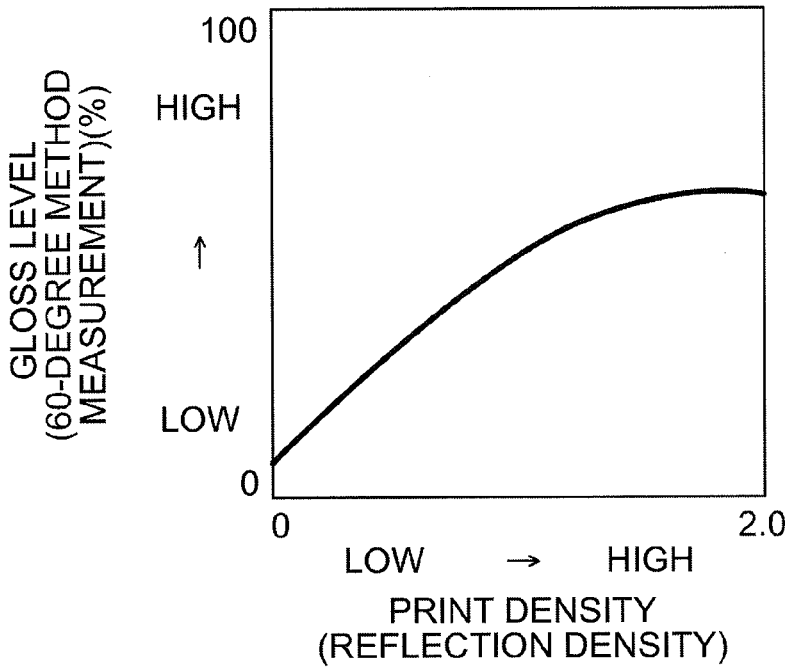
FIG. 9 is a graph illustrating an example of a relationship between a print density (reflection density) indicating a density of an image printed on recording paper P and a gloss level (measured by a 60-degree method) indicating a level of a gloss.

FIG. 9 is a graph illustrating an example of a relationship between a print density (reflection density) indicating a density of an image printed on recording paper P and a gloss level (measured by a 60-degree method) indicating a level of a gloss. The reflection density that is an optical density with respect to a recorded image on the paper is measured as a ratio of reflected light with respect to incident light. The gloss level indicates the light amount of regular reflection of light incident on the surface, and is measured at various incident angles. In this case, a 60-degree method gloss level that is measured using the incident angle of 60 degrees is adopted.

As illustrated in FIG. 9, when the reflection density is high, the gloss level is high, but when the reflection density is low, the gloss level is low. In an image where the reflection density is high, the number of dots constituting the image increases and the arrangement becomes dense. As a result, the surface is further smoothened and the gloss level becomes high. In general, the resin is contained in the toner. When the reflection density is high (the toner amount is large), the amount of the resin with respect to the recording paper increases. When the amount of the resin increases, the gloss level increases.

Accordingly, the image is formed such that the reflection density of the low gloss area becomes lower than the reflection density of the high gloss area, and the gloss level of the low gloss area becomes lower than the gloss level of the high gloss area and the gloss level of the high gloss area becomes relatively high.

Figure 10:
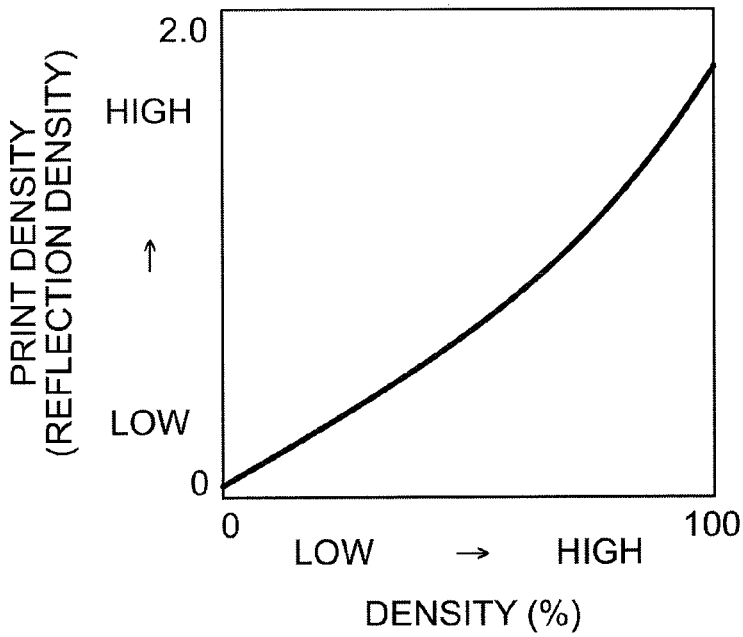
FIG. 10 is a graph illustrating an example of a relationship between multi-valued image data (density) and a print density (reflection density)

FIG. 10 is a graph illustrating an example of a relationship between multi-valued image data (density) and a print density (reflection density). As may be seen from the graph, when the density indicated by the multi-valued image data is high, the reflection density becomes high.

In the first exemplary embodiment, as described above, the density decreasing process is executed with respect to the image data of the second pass. At this time, the density decreasing process is executed such that a difference of the gloss levels of the high gloss area and the low gloss areas becomes a predetermined difference or more. The LUT may be previously set such that the density difference of the high gloss area and the low gloss area is visually determined, for example, the density difference becomes the gloss level difference of 30% or more by the 60-degree method measurement (it is different according to colors). The density difference may be set in consideration of the fixing condition.

Figure 11:
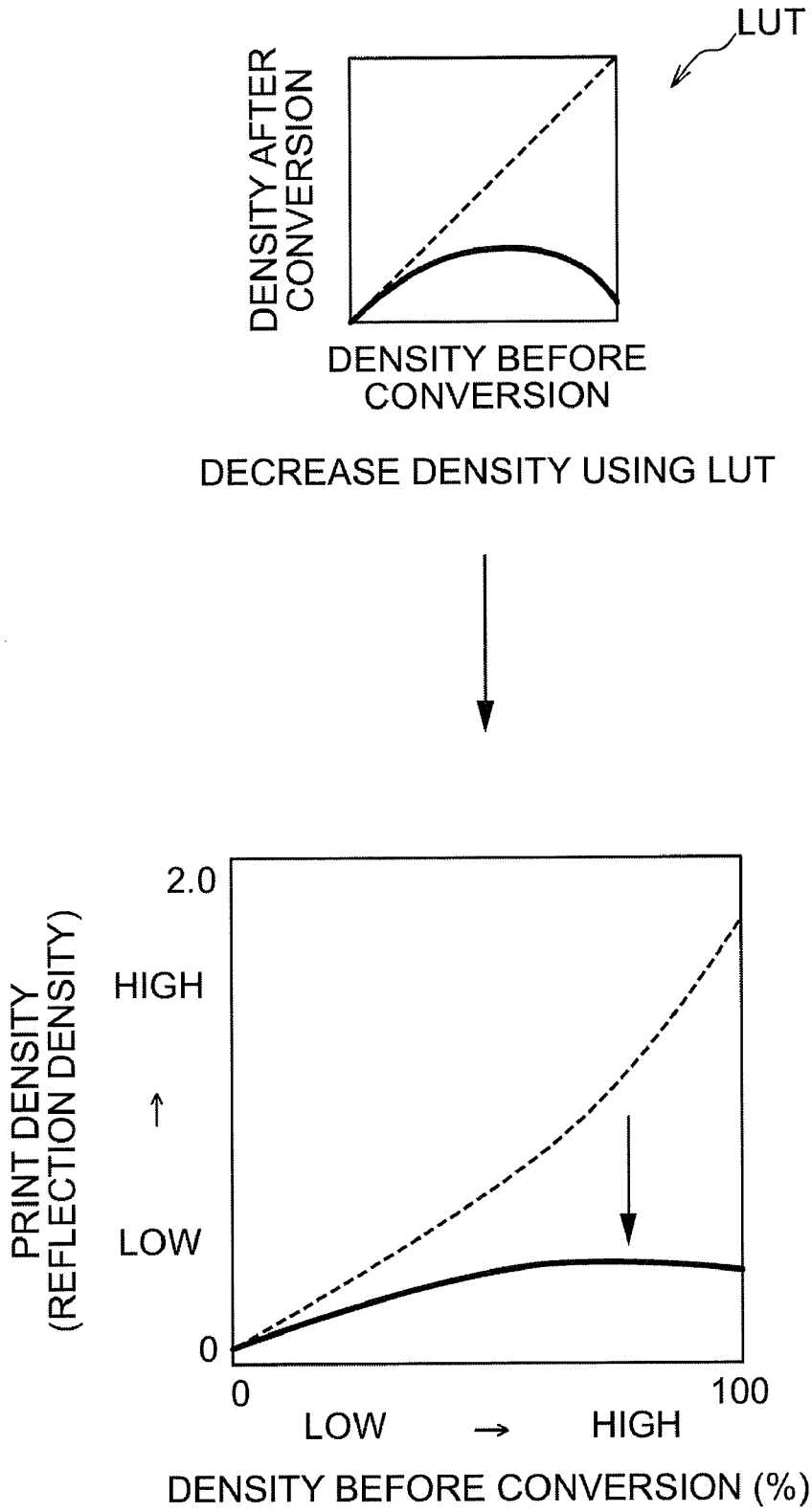
FIG. 11 is a diagram illustrating an example of a look-up table (LUT) used in a density decreasing process and an example of a relationship between a density of image data before changing the density of the image data to a lower density and a print density at the time of printing the image data after changing the density of the image data to the low density.

FIG. 11 illustrates an example of the LUT that is used in the density decreasing process. If the image data whose density is decreased using the LUT is digitized and printed, the print density becomes lower than the density before the conversion, as illustrated in FIG. 11.

When plural kinds of LUTs having different conversion characteristics are stored in the HDD 172, the LUT may be selected according to the density of the first image and used. For example, when the density of the first image is low, the LUT having the conversion rule that causes the density after the conversion to decrease may be selected and used.

In step 304, the image formation controller 20B forms an image of the first pass, on the basis of the output information data of the first pass, and fixes the image. The fixing condition at the time of fixing the image depends on the setting information. For example, when the setting information of the fixing condition is set to the pattern 1, the heating/fixing roll power supply 69 is controlled such that the fixing temperature becomes the temperature higher than the common temperature, the conveyance motor 80 is controlled such that the fixing speed becomes the speed slower than the common speed, and the support member driving motor 67 is controlled such that the contact width is wider than the common width. Thereby, an image that is illustrated in a left end of a lower stage of FIG. 8 is formed on the recording paper P.

In step 306, the image formation controller 20B forms an image of the second pass, on the basis of the output image data of the second pass, and fixes the image. The fixing condition at the time of fixing the image becomes the same fixing condition (the fixing temperature is set as the common temperature, the fixing speed is set as the common speed, and the contact width is set as the common width) as the fixing condition in the common mode. Thereby, an image that overlaps the image of the low gloss area formed in step 304 and is illustrated in the center of the lower stage of FIG. 8 is formed on the recording paper P.

Figure 12:
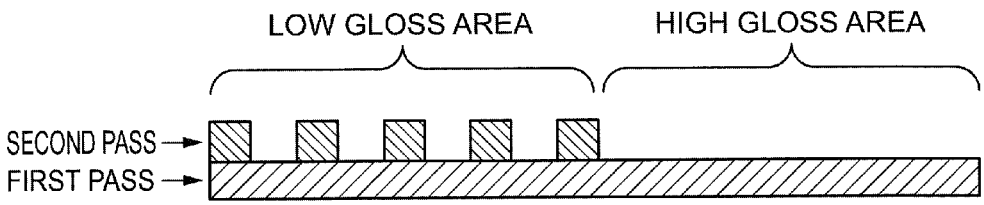
FIG. 12 is a schematic cross-sectional view illustrating a high gloss area and a low gloss area of the partial gloss image.

The final print result of the partial gloss image is illustrated in a right end of the lower stage of FIG. 8. FIG. 12 is a schematic cross-sectional view illustrating a high gloss area and a low gloss area of the partial gloss image. The density of the image that is formed in the high gloss area is higher than the density of the image that is formed in the low gloss area in the second pass (the number of dots increases and the arrangement becomes dense), and unevenness of the surface decreases as compared with the unevenness of the surface in the low gloss area. Meanwhile, in the low gloss area, the image of the second pass is formed to overlap the image formed in the image formation of the first pass. However, the density of the image of the second pass is lower than the density of the image that is formed in the high gloss area in the first pass, the number of dots decreases and the arrangement does not become dense, and the unevenness of the surface increases as compared with the unevenness of the surface in the high gloss area.

Accordingly, in the partial gloss image, a smoothness level of the surface of the high gloss area is higher than a smoothness level of the surface of the low gloss area, the light amount of regular reflection of the incident light increases, and the gloss level relatively increases. Meanwhile, the smoothness level of the surface of the low gloss area is lower than smoothness level of the surface of the high gloss area, the reflected light of the incident light diffuses, the light amount of regular reflection of the incident light decreases, and the gloss level of the low gloss area becomes lower than that of the high gloss area.

Figure 13:
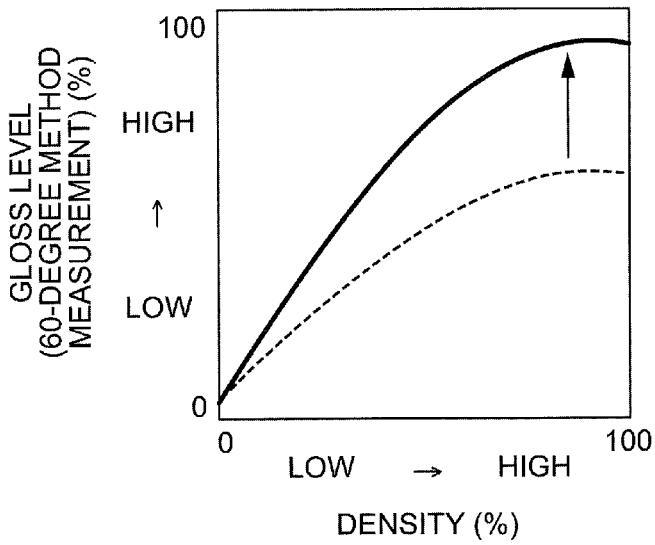
FIG. 13 is a diagram illustrating an example of a change in the gloss level when the image data is printed after a fixing temperature and a fixing time are increased.

In step 304, at least one of control to cause the fixing temperature of the first pass to be higher than the fixing temperature of the second pass, control to cause the fixing speed of the first pass to be slower than the fixing speed of the second pass, and control to cause the contact width of the first pass to be wider than the contact width of the second pass is performed, such that the surface of the high gloss area is smoothened more than the surface of the low gloss area formed in the second pass. FIG. 13 illustrates an example of a change in the gloss level when print is performed at the fixing temperature higher than the fixing temperature (common temperature) in the common mode for the fixing time longer than the fixing time in the common mode. A broken line indicates a relationship between the density and the gloss level when the print is performed in a state where the fixing temperature is set as the common temperature and the fixing time is set as the common fixing time. A thick solid line indicates a relationship between the density and the gloss level when the print is performed in a state where the fixing temperature is set to be higher than the common temperature and the fixing time is set to be longer than the common fixing time. As illustrated in FIG. 13, when the density increases, the gloss level increases.

Even when the fixing condition (the fixing temperature, the fixing speed, and the contact width) is the same in the first pass and the second pass, the fixing time with respect to the first image that is formed in the first pass becomes a sum of the fixing time of the first pass and the fixing time of the second pass and becomes longer than the fixing time with respect to the second image formed in the second pass, and the smoothness level of the surface of the image of the high gloss area is improved. That is, the amount of heat per unit area that is applied to the first image at the time of fixing becomes a sum of the amount of heat per unit area applied at the time of fixing of the first pass and the amount of heat per unit area applied at the time of fixing of the second pass, and becomes larger than the amount of heat per unit area applied to the second image.

The fixing condition where the amount of heat per unit area applied to the second image is smaller than the amount of heat per unit area applied to the first image is not limited to the above example. For example, the fixing temperature of the first pass may be set as the common temperature, the fixing speed may be set as the common speed, and the contact width may be set as the common width, and the image may be fixed. The fixing condition of the second pass may be set like the following (1) to (7), and the image may be fixed.

(1) The fixing temperature may be set to be lower than that of the first pass, and the fixing speed and the contact width may be set to be the same as those of the first pass.

(2) The fixing speed may be set to be faster than that of the first pass and the fixing temperature and the contact width may be set to be same as those of the first pass.

(3) The contact width may be set to be narrower that that of the first pass and the fixing temperature and the fixing speed may be set to be the same as those of the first pass.

(4) The fixing temperature may be set to be lower than that of the first pass, the fixing speed may be set to be faster than that of the first pass, and the contact width may be set to be the same as that of the first pass.

(5) The fixing speed may be set to be faster than that of the first pass, the contact width may be set to be narrower than that of the first pass, and the fixing temperature may be set to be the same as that of the first pass.

(6) The fixing temperature may be set to be lower than that of the first pass, the contact width may be set to be narrower than that of the first pass, and the fixing speed may be set to be the same as that of the first pass.

(7) The fixing temperature may be set to be lower than that of the first pass, the fixing speed may be set to be faster than that of the first pass, and the contact width may be set to be narrower than that of the first pass.

The fixing temperature of the first pass may be set to be higher than the common temperature and the fixing temperature of the second pass may be set to be higher than the common temperature but lower than the fixing temperature of the first pass, and the image may be fixed. The fixing speed of the first pass may be set to be slower than the common speed and the fixing speed of the second pass may be set to be slower than the common speed but faster than the fixing speed of the first pass, and the image may be fixed. The contact width of the first pass may be set to be wider than the common width and the contact width of the second pass may be set to be wider than common width but narrower than the contact width of the first pass, and the image may be fixed.

Second Exemplary Embodiment

In the first exemplary embodiment, the case where the gloss area specifying information to specify the high gloss area is previously designated has been described, but the invention is not limited thereto. For example, the area that satisfies the predetermined condition may be set as the high gloss area and the partial gloss area may be formed. In the second exemplary embodiment, in an original image, an area where an attribute is a character is set as a high gloss area, an area where an attribute is a non-character is set as a low gloss area, and a partial gloss image is formed.

In the second exemplary embodiment, the predetermined condition (hereinafter, referred to as specific condition) to specify the high gloss area may be included in the print information and designated by the user. Separately from the print information, the user may designate the specific condition through the operation unit 22 and the specific condition may be stored in the HDD 173. The specific condition may be stored in the HDD 173 when the image forming apparatus 100 is manufactured. In the second exemplary embodiment, the designated specific condition may be included in the print information. In the second exemplary embodiment, since the configuration of the image forming apparatus 100 is the same as that of the first exemplary embodiment, the description thereof is omitted.

Next, the operation of the image forming apparatus 100 according to the second exemplary embodiment in the partial gloss mode will be described.

Figure 14:
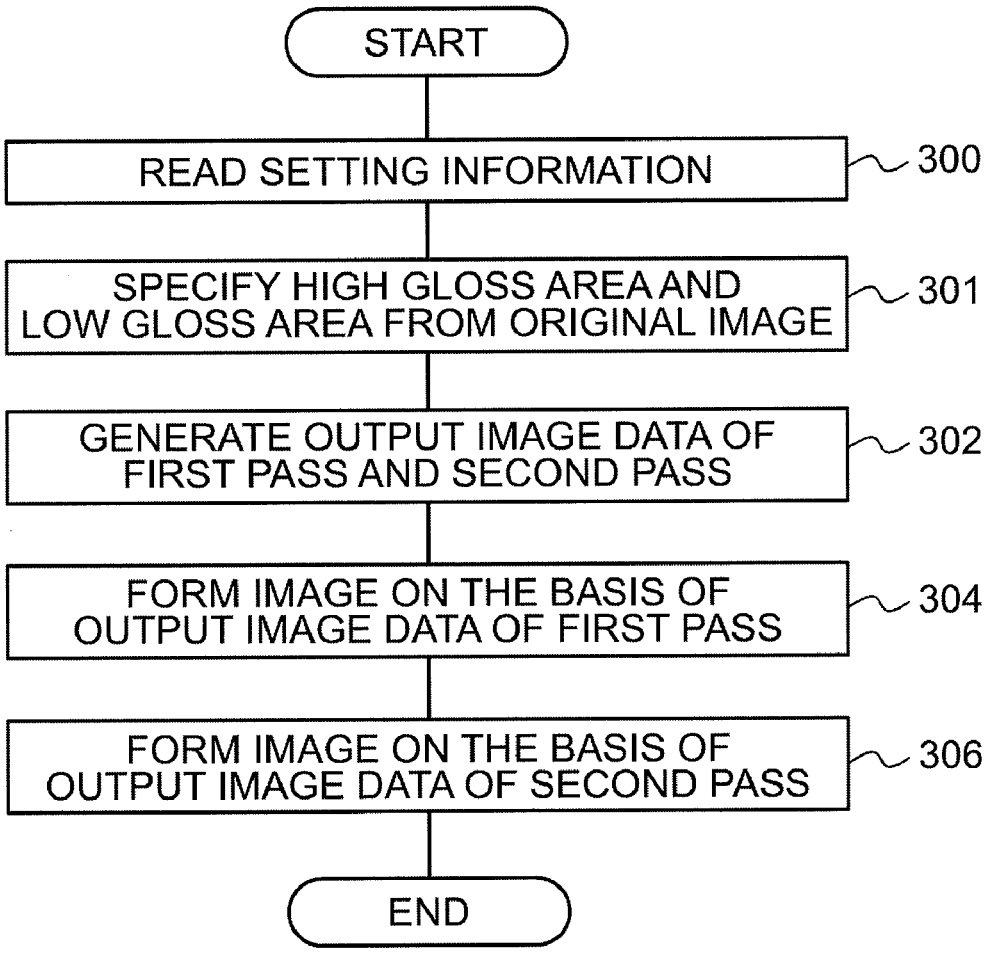
FIG. 14 is a flowchart illustrating a flow of another process routine that is executed by the control apparatus.

FIG. 14 is a flowchart illustrating a flow of a process routine according to the second exemplary embodiment that is executed by the control apparatus 20. The process routine starts when the control apparatus 20 receives a print instruction and the designation of the partial gloss mode included in the print information received together with the print instruction is "YES".

In FIG. 14, the steps that execute the similar processes as those of FIG. 7 are denoted by the same step numbers as those of FIG. 7, and the description is simplified or omitted.

The image data generator 20A reads the setting information from the HDD 173 in step 300. Next, in step 301, the image data generator 20A reads the print information that is stored in the HDD 173, and specifies the high gloss area and the low gloss area according to the specific condition (in this case, area where the attribute is the character=high gloss area) included in the print information. For example, using the known image area separation technology, such as edge extraction, the image data generator 20A may specify the area whose attribute is determined as the character as the high gloss area, and specify the other area as the low gloss area.

When attribute information indicating a character or a photo for each of pixels (or for each of plural small areas having the predetermined size) constituting the original image is included in the print information, the image data generator 20A may specify the area where the attribute is the character as the high gloss area, according to the attribute information.

Since the processes of steps 302 to 306 are the same as those of the first embodiment, the description thereof is omitted.

In this case, the area in the original image where the attribute is the character is specified as the high gloss area, but the area where the attribute is the non-character area may be specified as the high gloss area. An area having the predetermined color may be specified as the high gloss area. The area in the original image where the density is higher than the predetermined density may be specified as the high gloss area.

Third Exemplary Embodiment

When the predetermine condition where the original image is an image represented with two different densities, the area having the relatively high density of the two densities is set as the high gloss area, and the partial gloss image is formed (or when the condition is set by the user as described in the second exemplary embodiment) is previously set, the output image data may be generated and the partial gloss image may be printed, as follows.

Figure 15:
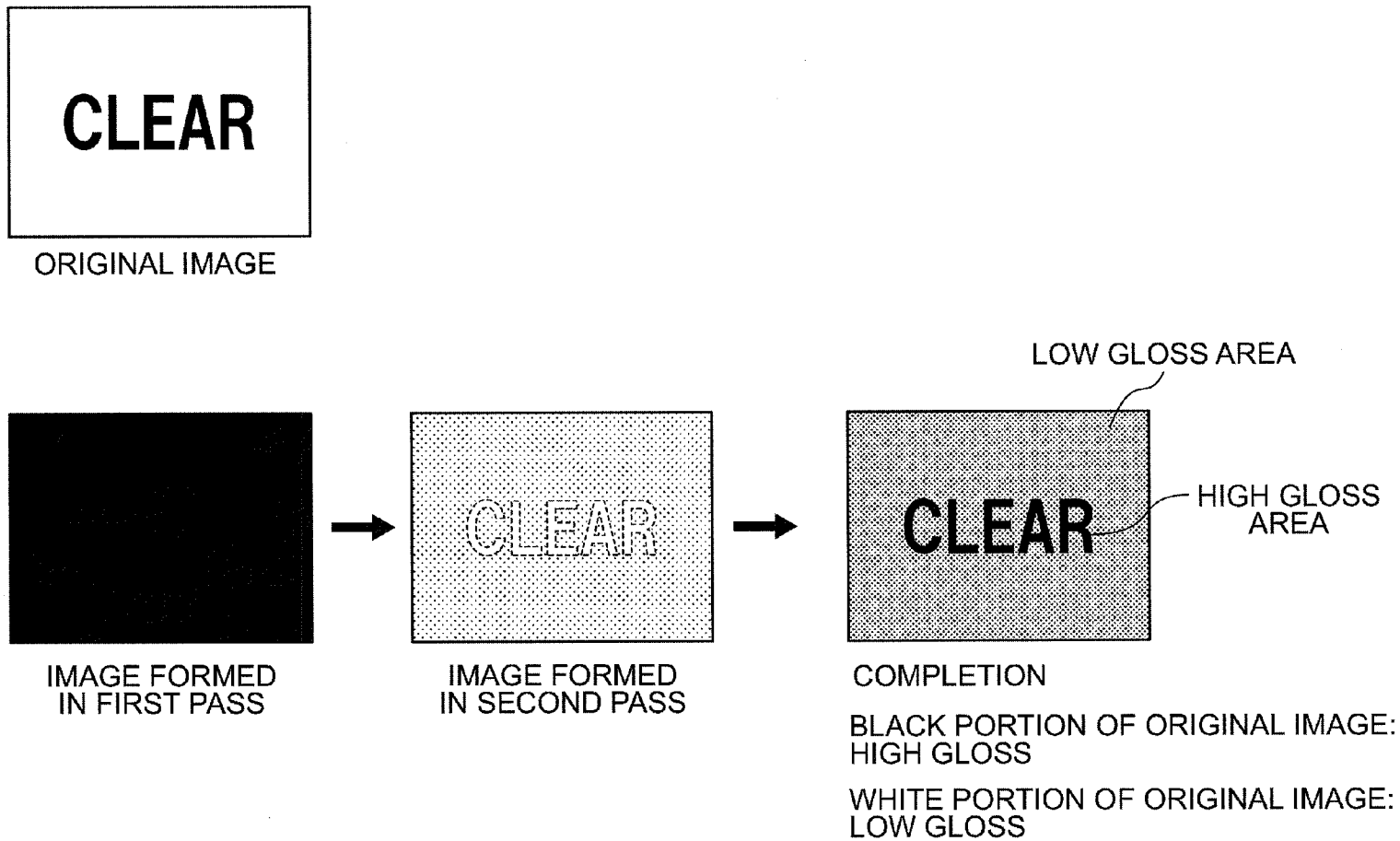
FIG. 15 is a diagram illustrating another example of a forming sequence of the partial gloss image.

In this case, as illustrated in the original image of FIG. 15, a monochrome original image that includes a black character "CLEAR" and a white background will be exemplified.

A process routine that is executed in the third exemplary embodiment is the same as that of the first exemplary embodiment illustrated in FIG. 14, except for a method of generating output image data in step 302. Hereinafter, the method of generating output image data in step 302 will be described.

The image data generator 20A calculates a density for each color of Y, M, C, and K for each pixel of the original image, on the basis of the print information. In the third exemplary embodiment, since the original image is a monochrome image, the density of the color of K is required. The image data generator 20A extracts the relatively high density (black color in this case) of the two densities and generates image data where the entire image has the high density (black color), as illustrated in the left end of the lower stage of FIG. 15. The image data generator 20A digitizes the image data and generates the output image data of the first pass.

Next, the image data generator 20A generates image data of an inversion image where the contrasting density of the original image is inverted. At this time, a black portion of the inversion image becomes a low gloss area and a white portion thereof becomes a high gloss area. As illustrated in the center of the lower stage of FIG. 15, the image data generator 20A generates image data where the density of a pixel of K of the image data is decreased to the predetermined density (for example, density of 15% when the density is represented by %). The density of the white portion of the inversion image does not change. The image data generator 20A executes the known dither processing with respect to the multi-valued image data after the density decreasing process, using the dither matrix stored in the HDD 173, digitizes the image data, and generates output image data of the second pass. The image data generator 20A may execute the density decreasing process as the LUT.

In step 304, the image formation controller 20B forms the image of the first pass on the basis of the output image data of the first pass and fixes the image (also refer to the left end of the lower stage of FIG. 15). In step 306, the image formation controller 20B forms the image of the second pass to overlap the image of the low gloss area formed in the first pass, on the basis of the output image data of the second pass, and fixes the image (also refer to the center of the lower stage of FIG. 15). The fixing condition depends on the setting information. Thereby, as illustrated in the right end of the lower stage of FIG. 15, a partial gloss image that has a high gloss area and a low gloss area having a gloss level lower than that of the high gloss area is printed. In FIG. 15, a partial gloss image that represents the gloss level difference of the high gloss area and the low gloss area is schematically illustrated.

The user may designate a color of at least one of the high gloss area and the low gloss area of the partial gloss image, regardless of the color of the original image.

For example, before step 302, the user designates the color of the high gloss area (or the low gloss area) of the partial gloss image through the operation unit 22. The designated color is received by the CPU 170 and stored in the RAM 171. The color of the high gloss area (or the low gloss area) may be designated by the computer 200 and the designation result may be included in the print information.

Next, a specific example will be described. The original image becomes an image that has two different densities, like the original image of FIG. 15.

When the image data generator 20A generates the output image data of the first pass in step 302, first, the image data generator 20A generates image data for each color of Y, M, C, and K where the color of the entire image becomes a color designated by the user, on the basis of the print information, regardless of the color of the original image. The image data generator 20A digitizes the image data and generates the output image data of the first pass.

Next, the image data generator 20A generates image data of an inversion image that is obtained by inverting a contrasting density of an image where the color of the portion having the relatively high density of the two densities in the original image is replaced by the color designated by the user. The image data generator 20A generates mage data for each color of Y, M, C, and K where the density of the image data is decreased to the predetermined density (for example, density of 15% when the density is represented by %). The density of the white portion of the inversion image does not change. The image data generator 20A executes the known dither processing with respect to the multi-valued image data after the density decreasing process, using the dither matrix stored in the HDD 173, digitizes the image data, and generates output image data of the second pass.

If the image data generator 20A forms an image using the processes of steps 304 and 306 on the basis of the output image data, the portion of the original image having the relatively high density is printed with the designated color and an image having a high gloss level is printed. The portion of the original image having the relatively low density is printed with the color obtained by decreasing the density of the designated color and an image that has a gloss level lower than that of the high gloss portion is printed. In this case, the case where the color of one of the high gloss area and the low gloss area is designated is exemplified. However, colors of both the high gloss area and the low gloss area may be designated. Plural LUTs having different conversion characteristics may be stored such that the color may be changed, and a color of the image of the high gloss area and the low gloss area may be changed using the LUT that is selected by the user through the operation unit 22.

Fourth Exemplary Embodiment

In the first to third exemplary embodiments, the first image is formed in the high gloss area and the low gloss area and is fixed in the first pass, and the second image that has the density lower than the density of the first image is formed in the low gloss area to overlap the image formed in the first pass and is fixed in the second pass, but the invention is not limited thereto. For example, the first image may be formed in the high gloss area and may be fixed in the first pass, and the second image may be formed in the low gloss image and may be fixed in the second pass.

Figure 16:
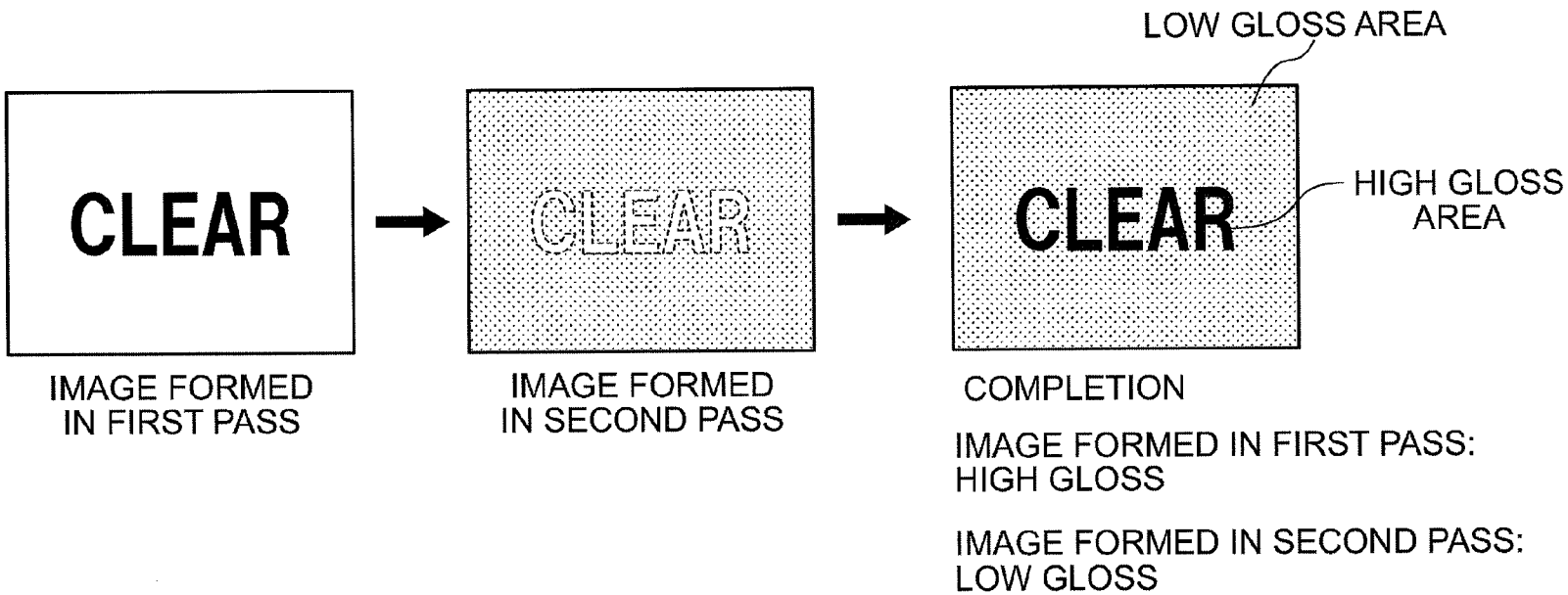
FIG. 16 is a diagram illustrating still another example of a forming sequence of the partial gloss image.

For example, when the original image is set as the image illustrated in the original image of FIG. 15, the output image data of the first pass is generated by digitizing the image data indicating the original image. The output image data of the second pass is generated by decreasing the density of the inversion image to the predetermined density and digitizing the image data of the inversion image, as described in the third exemplary embodiment. If the image is formed on the basis of the generated output image data, first, an image indicating the original image is generated in the first pass as illustrated in the left end of FIG. 16. In the second pass, as illustrated in the center of FIG. 16, an image where the contrasting density of the original image is inverted and the density is decreased is formed. As a result, as illustrated in the right end of FIG. 16, the area of the image that is formed in the first pass becomes the high gloss area, and the area of the image that is formed in the second pass becomes the low gloss area whose gloss level is lower than that of the image formed in the first pass.

The fixing conditions in the first pass and the second pass may be different from each other, as described in the first exemplary embodiment. Even if the fixing conditions in the first pass and the second pass are the same, the fixing time with respect to the high gloss area is lengthened due to the two-time execution of the fixing process. For this reason, the smoothness level of the surface becomes higher than that of the image of the low gloss area.

The image forming method according to the fourth exemplary embodiment may be applied to the case where the gloss area specifying information is separately designated with respect to the original image, as exemplified in the first exemplary embodiment. The image of the high gloss area that is specified by the gloss area specifying information is formed in the first pass, and the density of the image of the low gloss area is decreased and the image of the low gloss area is formed in the second pass. As exemplified in the second exemplary embodiment, the image forming method is applied to the case where the partial gloss image is formed in a state in which the area satisfying the predetermined condition is used as the high gloss area. That is, the area satisfying the predetermined condition is specified as the high gloss area, the image of the high gloss area is formed in the first pass, and the density of the image of the low gloss area other than the high gloss area is decreased and the image of the low gloss area is formed in the second pass.

In the first pass, the first image may be formed in the area where the high gloss area is enlarged, such that the first image and the second image overlap at the boundary portion of the high gloss area and the low gloss area. In the second pass, the second image that has the density lower than that of the first image may be formed in the low gloss area.

Fifth Exemplary Embodiment

In the fifth exemplary embodiment, the density of the second image that is formed in the second pass is maintained as the density of the original image, the density of the first image that is formed in the first pass is increased to be higher than the density of the original image, and the partial gloss image is printed.

Figure 17:
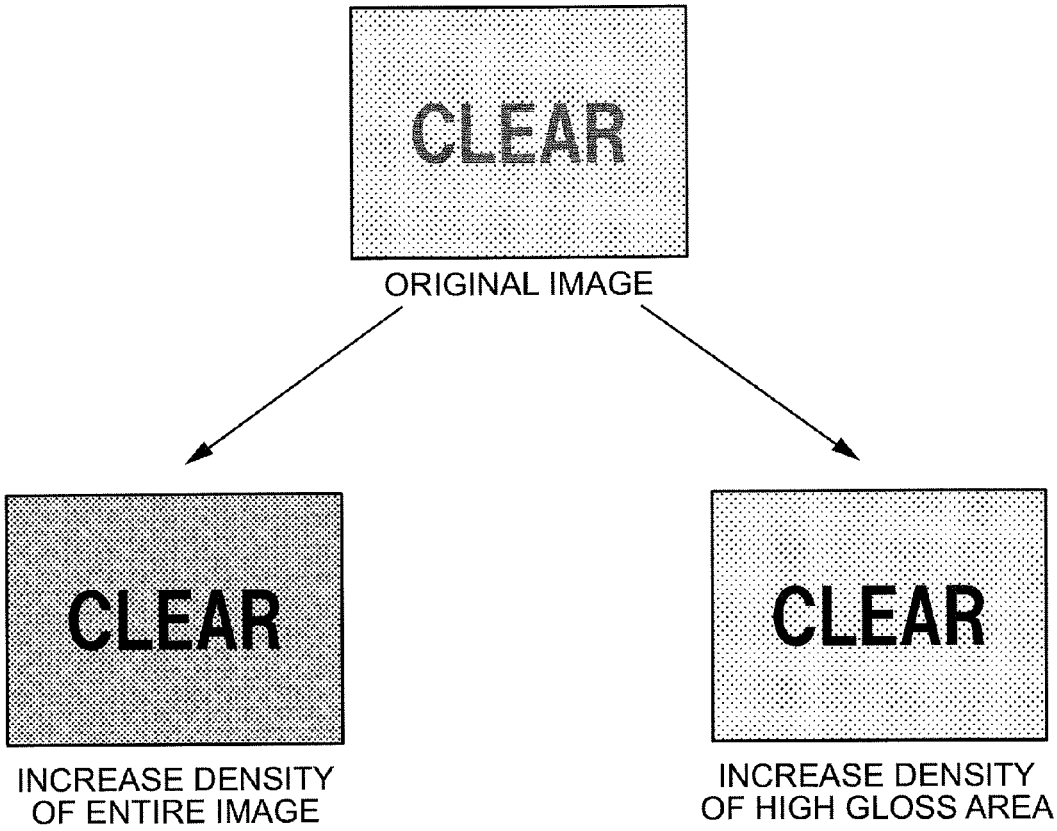
FIG. 17 is a diagram illustrating an example of a method of generating output image data of the first pass.

For example, the image data generator 20A confirms the density of the high gloss area of the original image that is indicated by the gloss area specifying information designated by the user in the first exemplary embodiment, or the density of the high gloss area specified as the area satisfying the predetermined condition in the second exemplary embodiment. When the density of the high gloss area of the original image is lower than the predetermined density, as illustrated in FIG. 17, the image data is converted such that the density of the high gloss area or the density of the entire image becomes the predetermined density or more, and is digitized, and the output image data of the first pass is generated. In the conversion, the conversion rule (for example, LUT) that converts the image data to have the density higher than the density before the conversion may be previously stored in the storage unit, such as the HDD 173, and the image data may be converted using the conversion rule. The density may be increased with a constant ratio, such that the density of each pixel of the high gloss area becomes the predetermined density.

Next, the image data generator 20A converts the density of each pixel of the high gloss area in the original image into 0 (white) and the density of each pixel of the low gloss area is used as it is, and the multi-valued image data is generated. In this case, the process that decreases the density of the low gloss area is not executed. The multi-valued image data is digitized and the output image data of the second pass is generated. The density of each pixel of the low gloss area in the original image becomes the density that is the predetermined amount different from the density of each pixel of the high gloss area subjected to the density increasing process.

The image formation controller 20B forms the images through the two passes in steps 304 and 306, on the basis of the generated output image data.

The density increasing process may be executed such that the density of the first image formed in the first pass becomes the predetermined density a or more, and the output image data of the first pass may be generated. The density decreasing process may be executed such that the density of the second image of the low gloss area formed in the second pass becomes the predetermined density $\beta$ (in this case, $\alpha>\beta$) or less, and the output image data of the second pass may be generated. The plural kinds of different conversion rules where the density is converted into the density higher than the density before the conversion may be stored, the conversion rule that is selected by the user from the plural conversion rules may be received, the density may be converted using the received conversion rule, and the output image data to form the first image may be generated.

[Others]

In the above-described exemplary embodiments, the image forming apparatus 100 generates the output image data of the first and second passes from the image data of the original image, but the invention is not limited thereto. For example, the computer 200 may generate the output image data of the first and second passes and transmit the output image data to the image forming apparatus 100, and the image forming apparatus 100 may form an image on the basis of the transmitted output image data. In regards to the fixing condition, the data that designates the fixing condition may be transmitted from the computer 200, and the fixing condition may be controlled. The information indicating the fixing condition may be designated by the user, the information may be included in the print information, the print information may be transmitted from the computer 200 to the image forming apparatus 100, and the fixing condition may be controlled. The user may designate the LUT and the color using the computer 200, the designation result may be included in the print information, and the print information may be transmitted to the image forming apparatus 100.

Figure 18:
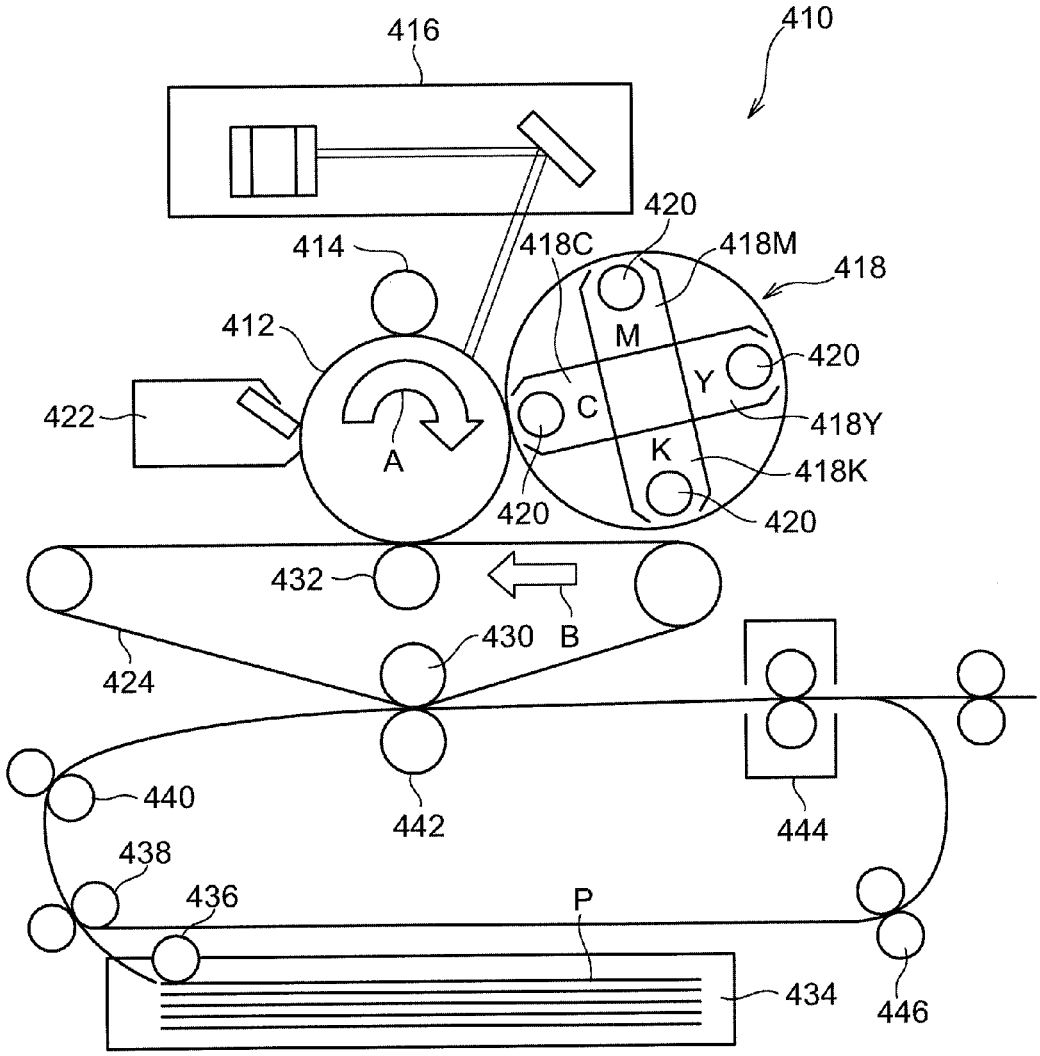
FIG. 18 is a diagram illustrating an example of an image forming apparatus that has an image forming unit provided with a rotary developing device.

The image forming apparatus 100 is not limited to the tandem-type configuration. For example, as illustrated in FIG. 18, the image forming apparatus 100 may be an image forming apparatus 410 that has an image forming unit where a rotary developing device 418 is provided.

A photoreceptor 412 may be provided to rotate in a direction of an arrow A by a motor (not illustrated). Around the photoreceptor 412, a charge roll 414, an exposing device 416, a developing device 418, a primary transfer device 432, and a cleaning device 422 are disposed.

The charge roll 414 charges a surface of the photoreceptor 412 and the exposing device 416 exposures the charged surface of the photoreceptor 412 using a laser beam and forms an electrostatic latent image, according to image data.

In the developing device 418, developers 418Y, 418M, 418C, and 418K using toners of individual colors of Y, M, C, and K are disposed along a circumferential direction. The developers 418Y, 418M, 418C, and 418K include development rolls 420 and store toners of the individual colors of Y, M, C, and K, respectively. The developers 418Y, 418M, 418C, and 418K develop the electrostatic latent image on the photoreceptor 412 with the toners of the individual colors of Y, M, C, and K, respectively. When the electrostatic latent image is developed, the developing device 418 is rotated by a motor (not illustrated), and the corresponding developer is positioned to face the electrostatic latent image of the photoreceptor 412.

The individual toner images that are developed on the photoreceptor 412 are sequentially transferred to an intermediate transfer belt 424 that is rotated in a direction of an arrow B by the primary transfer device 432, and the individual toner images overlap.

The recording paper P that is extracted from a recording paper storage unit 434 and fed to a conveyance path by a roll 436 is conveyed to a transfer position of a secondary transfer roll pair 430 and 442 by a roll pair 438 and 440. The toner image that is formed on the intermediate transfer belt 424 is transferred to the recording paper P at the transfer position, thermally fixed by a fixing device 444, and discharged to a discharge portion (not illustrated).

In the partial gloss mode, the recording paper P where forming and fixing of an image of a first pass are completed is returned to the conveyance path again by a roll pair 446 and conveyed to the transfer position of the secondary transfer device 442 by the roll pair 438 and 440, and forming and fixing of an image of a second pass are performed.

The image forming apparatus 410 may be applied as the image forming apparatus that prints the partial gloss image, as illustrated in the above-described exemplary embodiments.

In the above-described exemplary embodiments, the generating process of the output image data is executed by the software, but may be executed by hardware.

In the above-described exemplary embodiments, the toner is used as the colored image formation material, but ink may be used.

What is claimed is:

1. An image gloss control apparatus comprising:

a first control component that controls an image forming/fixing component, which forms an image on a recording medium using a colored image formation material and fixes the image, so that a first image is formed in a high gloss area having a high gloss level on the recording medium or an area including the high gloss area on the recording medium and is fixed to generate a high gloss image in the high gloss area; and a second control component that controls the image forming/fixing component, so that a second image having a density lower than a density of the first image is formed in a low gloss area having a gloss level lower than the gloss level of the high gloss area on the recording medium where the first image is formed or the low gloss area on the first image and is fixed, wherein the high gloss image is generated without using a transparent toner layer.

2. The image gloss control apparatus of claim 1 further comprising:

a receiving component that receives a conversion rule selected by a user from a plurality of conversion rules having different conversion characteristics for converting a density into a lower density, wherein a density of an original image when the second image is formed is converted into a lower density using the conversion rule received by the receiving component to form the second image is formed.

3. The image gloss control apparatus of claim 1 further comprising:

a second receiving component that receives a conversion rule selected by a user from a plurality of conversion rules having different conversion characteristics for converting a density into a higher density, wherein a density of an original image when the first image is formed is converted into a higher density using the conversion rule received by the second receiving component to form the first image.

4. The image gloss control apparatus of claim 1, wherein an amount of heat per unit area applied to the second image when the second image is fixed is set to be smaller than an amount of heat per unit area applied to the first image when the first image is fixed.

5. The image gloss control apparatus of claim 1 further comprising:

a specifying component that reads a condition for specifying the high gloss area from a storage component where the condition is stored, and specifies an area where the read condition is satisfied as the high gloss area.

6. The image gloss control apparatus of claim 1 further comprising:

a color receiving component that receives a color designated by a user; and a color control component that controls a color, so that a color of at least one of the first image formed by the first control component and the second image formed by the second control component is set to the color received by the color receiving component.

7. The image gloss control apparatus of claim 1, wherein the first image is formed using only the colored image formation material.

8. An image forming apparatus comprising:

an image forming/fixing component that forms an image on a recording medium using a colored image formation material and fixes the image; and an image gloss control apparatus that includes:

a first control component that controls the image forming/fixing component, which forms the image on the recording medium using the colored image formation material and fixes the image, so that a first image is formed in a high gloss area having a high gloss level on the recording medium or an area including the high gloss area on the recording medium and is fixed to generate a high gloss image in the high gloss area, and a second control component that controls the image forming/fixing component, so that a second image having a density lower than a density of the first image is formed in a low gloss area having a gloss level lower than the gloss level of the high gloss area on the recording medium where the first image is formed or the low gloss area on the first image and is fixed, wherein the high gloss image is generated without using a transparent toner layer.

9. The image forming apparatus of claim 8, wherein:

the image gloss control apparatus further comprises a receiving component that receives a conversion rule selected by a user from a plurality of conversion rules having different conversion characteristics for converting a density into a lower density, and a density of an original image when the second image is formed is converted into a lower density using the conversion rule received by the receiving component to form the second image is formed.

10. The image forming apparatus of claim 8, wherein:

the image gloss control apparatus further comprises a second receiving component that receives a conversion rule selected by a user from a plurality of conversion rules having different conversion characteristics for converting a density into a higher density, and a density of an original image when the first image is formed is converted into a higher density using the conversion rule received by the second receiving component to form the first image.

11. The image forming apparatus of claim 8, wherein the image gloss control apparatus sets an amount of heat per unit area applied to the second image when the second image is fixed to be smaller than an amount of heat per unit area applied to the first image when the first image is fixed.

12. The image forming apparatus of claim 8, wherein the image gloss control apparatus further comprises a specifying component that reads a condition for specifying the high gloss area from a storage component where the condition is stored, and specifies an area where the read condition is satisfied as the high gloss area.

13. The image forming apparatus of claim 8, wherein the image gloss control apparatus further comprises:

a color receiving component that receives a color designated by a user; and a color control component that controls a color, so that a color of at least one of the first image formed by the first control component and the second image formed by the second control component is set to the color received by the color receiving component.

14. An image forming apparatus comprising:

an image forming/fixing component that forms an image on a recording medium using a colored image formation material and fixes the image;

a first control component that controls the image forming/fixing component, so that a first image is formed in a high gloss area having a high gloss level on the recording medium or an area including the high gloss area on the recording medium and is fixed at a fixing temperature higher than a predetermined fixing temperature to generate a high gloss image in the high gloss area; and a second control component that controls the image forming/fixing component, so that a second image having a density lower than a density of the first image is formed in a low gloss area having a gloss level lower than the gloss level of the high gloss area on the recording medium where the first image is formed or the low gloss area on the first image and is fixed at a fixing temperature lower than the fixing temperature controlled by the first control component wherein the high gloss image is generated without using a transparent toner layer.

15. An image forming system, comprising:

an image gloss control apparatus that includes:

a first generating component that generates image information indicating a first image, so that the first image is formed in a high gloss area having a high gloss level on a recording medium or an area including the high gloss area on the recording medium and is fixed, a second generating component that generates image information indicating a second image, so that the second image having a density lower than a density of the first image is formed in a low gloss area having a gloss level lower than the gloss level of the high gloss area on the recording medium where the first image is formed or the low gloss area on the first image and is fixed, and a transmitting component that transmits the image information generated by the first and second generating components; and an image forming apparatus that includes:

a receiving component that receives the image information generated by the first and second generating components from the image gloss control apparatus, and an image forming/fixing component that forms the first image in the high gloss area on the recording medium or the area including the high gloss area using a colored image formation material, on the basis of the received image information indicating the first image, and fixes the first image to generate a high gloss image in the high gloss area, and that forms the second image in the low gloss area on the recording medium where the first image is formed or the low gloss area on the first image, on the basis of the received image information indicating the second image, and fixes the second image, wherein the high gloss image is generated without using a transparent toner layer.

16. A storage medium readable by a computer, the storage medium storing a program of instructions executable by the computer to perform a function, the function comprising:

controlling an image forming/fixing component forming an image on a recording medium using a colored image formation material and fixing the image, so that a first image is formed in a high gloss area having a high gloss level on the recording medium or an area including the high gloss area on the recording medium and is fixed to generate a high gloss image in the high gloss area; and controlling the image forming/fixing component, so that a second image having a density lower than a density of the first image is formed in a low gloss area having a gloss level lower than the gloss level of the high gloss area on the recording medium where the first image is formed or the low gloss area on the first image and is fixed, wherein the high gloss image is generated without using a transparent toner layer.

17. The storage medium of claim 16, wherein: the function further comprises receiving a conversion rule selected by a user from a plurality of conversion rules having different conversion characteristics for converting a density into a lower density, a density of an original image when the second image is formed is converted into a lower density using the received conversion rule to form the second image.

18. The storage medium of claim 16, wherein: the function further comprises receiving a conversion rule selected by a user from a plurality of conversion rules having different conversion characteristics for converting a density into a higher density, a density of an original image when the first image is formed is converted into a higher density using the received conversion rule to form the first image.

19. The storage medium of claim 16, wherein an amount of heat per unit area applied to the second image when the second image is fixed is set to be smaller than an amount of heat per unit area applied to the first image when the first image is fixed.

20. The storage medium of claim 16, wherein the function further comprises reading a condition for specifying the high gloss area from a storage component where the condition is stored, and specifying an area where the read condition is satisfied as the high gloss area.

21. The storage medium of claim 16, wherein the function further comprises:

receiving a color designated by a user; and controlling to set a color of at least one of the first image and the second image to the received color.

* * * * *